US009751722B2

(12) United States Patent
Kawauchi et al.

(10) Patent No.: US 9,751,722 B2
(45) Date of Patent: Sep. 5, 2017

(54) ELONGATED SHEET FEEDING REEL

(75) Inventors: Yasuyuki Kawauchi, Sakai (JP); Yoshihiro Kondo, Sakai (JP)

(73) Assignee: FUJI SEAL INTERNATIONAL, INC., Osaka (JP)

( * ) Notice: Subject to any disclaimer, the term of this patent is extended or adjusted under 35 U.S.C. 154(b) by 254 days.

(21) Appl. No.: 14/110,562

(22) PCT Filed: Apr. 24, 2012

(86) PCT No.: PCT/JP2012/060982

§ 371 (c)(1),
(2), (4) Date: Oct. 8, 2013

(87) PCT Pub. No.: WO2012/147748

PCT Pub. Date: Nov. 1, 2012

(65) Prior Publication Data

US 2014/0027558 A1 Jan. 30, 2014

(30) Foreign Application Priority Data

Apr. 26, 2011 (JP) ..... 2011-098506

(51) Int. Cl.
*B65H 75/24* (2006.01)
*B65H 49/32* (2006.01)
(Continued)

(52) U.S. Cl.
CPC ..... *B65H 75/242* (2013.01); *B65H 49/328* (2013.01); *B65H 75/12* (2013.01);
(Continued)

(58) Field of Classification Search
CPC .. B65H 2701/37; B65H 49/328; B65H 75/12; B65H 75/242; B65H 75/245; B65H 75/26; B65H 2701/534
(Continued)

(56) References Cited

U.S. PATENT DOCUMENTS 3,430,886 A * 3/1969 Sweeney ..... A01K 89/00 242/118.41
3,603,526 A * 9/1971 Payne et al. ..... 242/129.8
(Continued)

FOREIGN PATENT DOCUMENTS

JP A-2000-86025 3/2000
JP A-2000-109165 4/2000
(Continued)

OTHER PUBLICATIONS

International Search Report issued in International Patent Application No. PCT/JP2012/060982 dated Jul. 17, 2012 (with translation).
(Continued)

*Primary Examiner* — Emmanuel M Marcelo
*Assistant Examiner* — Michael Gallion
(74) *Attorney, Agent, or Firm* — Oliff PLC

(57) ABSTRACT

A delivery reel for an elongated sheet, having a disk-shaped flange member on which a sheet roll is positioned; an auxiliary core member of generally cylindrical shape split in the circumferential direction to enable expansion in diameter, and inserted into the inside diameter part of the sheet roll; a main core member fitted into the auxiliary core member which has been inserted into the sheet roll; and a stopper member attached to the circumferential edge of the flange member, and jutting toward the outside in the radial direction. The main core member has a plate spring. In a state in which the auxiliary core member has been inserted into the inside diameter part of the sheet roll, and the main core member has been fitted into the auxiliary core member, the plate spring presses the inside peripheral surface of the auxiliary core member toward the outside in the radial direction.

21 Claims, 16 Drawing Sheets

(51) Int. Cl.
*B65H 75/26* (2006.01)
*B65H 75/12* (2006.01)

(52) U.S. Cl.
CPC ..... *B65H 75/245* (2013.01); *B65H 75/26* (2013.01); *B65H 2701/37* (2013.01); *B65H 2701/534* (2013.01)

(58) Field of Classification Search
USPC ..... 242/571
See application file for complete search history.

(56) References Cited

U.S. PATENT DOCUMENTS

| | | | | |
|---|---|---|---|---|
| 3,836,090 | A * | 9/1974 | Mix | 242/160.2 |
| 3,902,679 | A * | 9/1975 | Bost | B65H 49/02 242/125.1 |
| 3,970,268 | A * | 7/1976 | Sheetz | B65H 75/14 242/118.4 |
| 6,402,084 | B1 * | 6/2002 | Michel | B65H 75/243 242/571.1 |
| 6,460,796 | B1 * | 10/2002 | Berning | B65H 75/24 137/355.16 |
| 2003/0111573 | A1 * | 6/2003 | Kinoshita | B65H 49/26 242/597.4 |
| 2003/0116675 | A1 * | 6/2003 | Heuser | B65H 75/246 242/571 |
| 2006/0180699 | A1 * | 8/2006 | Cranston et al. | 242/571 |
| 2009/0152390 | A1 * | 6/2009 | Underbrink et al. | 242/432.6 |
| 2010/0025521 | A1 * | 2/2010 | Snitselaar | B65H 75/22 242/608.2 |
| 2013/0200193 | A1 * | 8/2013 | Lichoulas et al. | 242/118.3 |

FOREIGN PATENT DOCUMENTS

| | | |
|---|---|---|
| JP | A-2004-307083 | 11/2004 |
| JP | B2-3611462 | 1/2005 |
| JP | A-2008-213948 | 9/2008 |

OTHER PUBLICATIONS

International Preliminary Report on Patentability issued in International Patent Application No. PCT/JP2012/060982 dated Oct. 29, 2013.

* cited by examiner (a)

(b)

(a)

(b)

(a)

(b)

(c)

(a)

(b)

(a)

(b)

(a)

(b)

ELONGATED SHEET FEEDING REEL

TECHNICAL FIELD

The invention relates to an elongated sheet feeding reel, which is used by stacking elongated sheet feeding reels one on another in a multi-tiered manner with elongated sheets wound around the respective elongated sheet feeding reels, and in particular, relates to an elongated sheet feeding reel, which is suitable to be used when an elongated sheet in the upper tier is connected to an elongated sheet in the lower tier adjacent to the upper tier, thereby continuously feeding the elongated sheets.

BACKGROUND ART

Generally, a tubular label such as a shrink label, which is to be attached to a container or the like, is attached to the container or the like by a labeling apparatus sequentially cutting an elongated strip-like label forming base material that has been folded in a sheet with multiple labels connected together. Usually, such an elongated sheet-like label forming base material is used by: setting, on a feeding apparatus of the labeling apparatus, what has been obtained by winding the elongated sheet-like label forming base material into a roll around a paper tube (hereinafter referred to as a "sheet roll"); and continuously feeding the sheet roll.

Incidentally, the length of a label forming base material that can be wound into a roll has a natural limit. This requires the frequent replacement of the sheet roll set on the labeling apparatus. Consequently, it is not possible to allow the labeling apparatus to operate efficiently.

Thus, conventionally, sheet rolls are mounted on reels, and the reels are stacked one on another in a multi-tiered manner. Then, the sheet roll mounted on the reel in the upper tier is connected to the sheet roll mounted on the reel in the lower tier, thereby continuously feeding label forming base materials from the plurality of respective reels. This reduces the number of times the sheet rolls are replaced, thereby allowing a labeling apparatus to operate efficiently.

Usually, as shown in (a) and (b) of FIG. 17, such a reel includes: a cylindrical core member 51, to which a sheet roll is to be fit; and a flange member 52, which can be detachably attached to one end of the core member 51. Thus, as described above, to stack reels 50 one on another in a multi-tiered manner and continuously feed label forming base materials, a paper tube is removed from each sheet roll and an inner end portion (a winding start portion) of the sheet roll is pulled, out from the sheet roll. Thereafter, the sheet roll without the paper tube, or the sheet roll to which the removed paper tube has been attached again, is set on the core member 51 of the reel 50. Then, as shown in FIG. 18, while a plurality of reels 50 on which the sheet rolls have thus been set are stacked in a multi-tiered manner, an outer end portion (a winding end portion) or a pulled out inner end portion (a winding start portion) of a sheet roll R set on the reel 50 in the upper tier is connected to a pulled out inner end portion (a winding start portion) or an outer end portion (a winding end portion) of a sheet roll R set on the reel 50 in the lower tier adjacent to the upper tier. Thus, the sheet rolls R set on the plurality of reels 50 are connected to each other.

Such a reel 50 has the following advantage. Usually, the outer diameter of the core member 51 is set to be smaller than the inner diameter of the paper tube of the sheet roll R. Thus, it is possible to rotate the sheet roll R set on the core member 51 of the reel 50, relative to the reel 50, and when the sheet roll R is connected to the label forming base material of the sheet roll R set on the reel 50 in the lower tier, it is possible to adjust the connection position while rotating the sheet roll R relative to the reel 50. This achieves an excellent operability for connecting the label forming base materials.

As described above, however, in the case where, while the reels 50 on which the sheet rolls R are set are stacked one on another in a multi-tiered manner with some allowance between each core member 51 and the paper tube, the label forming base materials of the adjacent sheet rolls R are connected to each other and the label forming base materials are sequentially fed from the sheet roll R set on the reel 50 in the upper tier, the reels 50 stacked one on another in a multi-tiered manner rotate in an integrated manner. The label forming base material, however, of the sheet roll R from which the label forming base material is being fed is pulled by a downstream apparatus such as a labeler. Thus, the sheet roll R rotates relative to the reel 50. This causes a shift in the connection position of the label forming base materials relative to the sheet roll R set on the reel 50 in the lower tier adjacent to the upper tier. In the connection portion, the label forming base materials are pulled and twisted.

In response, hitherto, as shown in FIG. 19, non-slip members 53 formed of a material such as a rubber are bonded to the surface, of a flange member 52, that is in contact with the sheet roll R, thereby increasing the frictional force of the sheet roll R against the reel 50. This prevents unnecessary rotation of the sheet roll R relative to the reel 50.

CITATION LIST

Patent Literature

[PTL 1] Japanese Patent No. 3611462

SUMMARY OF THE INVENTION

Problems to be Solved by the Invention

Incidentally, as described above, if the non-slip members 53 formed of a material such as a rubber are bonded to the surface, of the flange member 52, that is in contact with the sheet roll R, it is true that it is possible to prevent unnecessary rotation of the sheet roll R relative to the reel 50. A new problem, however, may arise where, when the sheet roll R from which the label forming base material is being fed is switched from the sheet roll R in the upper tier to the sheet roll R in the lower tier, the winding end portion of the sheet roll R in the upper tier becomes caught by the non-slip members 53, and therefore, the label forming base material is not smoothly fed. Thus, the connection portion of the label forming base materials becomes twisted.

Therefore, it is an objective of the invention to provide an elongated sheet feeding reel capable of preventing unnecessary rotation of a sheet roll while an elongated sheet is being fed, and also capable of, even when the sheet roll from which the elongated sheet is being fed is switched to another sheet roll adjacent to the sheet roll, smoothly feeding the elongated sheet.

Solution to the Problems

To achieve the above objective, the invention of claim 1 provides an elongated sheet feeding reel for stacking sheet rolls, each of which has been formed by winding an elongated sheet around a tubular support, one on another in a multi-tiered manner, and for continuously feeding the elongated sheets from the respective sheet rolls, the elongated sheet feeding reel comprising: a core member configured to be fittingly inserted into a tubular support of a sheet roll; and a disk-shaped flange member configured to be detachably attached to at least one end of the core member. The core member has a pressing member configured to press an inner peripheral surface of the tubular support of the sheet roll radially outward.

Further, the invention of claim 2 is an elongated sheet feeding reel for stacking sheet rolls, each of which is formed by winding an elongated sheet without using a tubular support, and has an inner circular portion, one on another in a multi-tiered manner, and for continuously feeding the elongated sheets from the respective sheet rolls, the elongated sheet feeding reel comprising: a generally cylindrical secondary core member configured to be fittingly inserted into an inner circular portion of a sheet roll; a primary core member configured to be fittingly attached to an inside of the cylindrical secondary core member fittingly inserted in the sheet roll; and a disk-shaped flange member configured to be detachably attached to at least one end of the primary core member. The secondary core member is divided circumferentially so as to be able to expand a diameter thereof, the primary core member has a pressing member configured to press radially outward an inner peripheral surface of the secondary core member fittingly inserted in the inner circular portion of the sheet roll, and the elongated sheet feeding reel comprises a rotation stopping member for stopping rotation of the primary core member and the secondary core member relative to each other.

Further, the invention of claim 3 is an elongated sheet feeding reel for stacking sheet rolls, each of which is formed by winding an elongated sheet without using a tubular support and has an inner circular portion, one on another in a multi-tiered manner, and for continuously feeding the elongated sheets from the respective sheet rolls, the elongated sheet feeding reel comprising: a generally cylindrical secondary core member configured to be fittingly inserted into an inner circular portion of a sheet roll; a primary core member configured to be fittingly attached to an inside of the cylindrical secondary core member fittingly inserted in the sheet roll; and a disk-shaped flange member configured to be detachably attached to at least one end of the primary core member. The secondary core member is divided circumferentially so as to be able to expand a diameter thereof, and has a pressing member configured to press radially inward an outer peripheral surface of the primary core member attached to the secondary core member, and the elongated sheet feeding reel comprises a rotation stopping member for stopping rotation of the primary core member and the secondary core member relative to each other.

Advantageous Effects of the Invention

As described above, in the elongated sheet feeding reel according to the invention of claim 1, a core member, which is to be detachably attached to a flange member, has a pressing member, which is to press an inner peripheral surface of a tubular support of a sheet roll radially outward. Thus, with the sheet roll placed on the disk-shaped flange member to which the core member is not attached, the operation of connecting the elongated sheets is performed. After the connecting operation has been completed, the core member is fittingly inserted into the tubular support of the sheet roll and attached to the flange member. Consequently, the pressing member presses the inner peripheral surface of the tubular support of the sheet roll radially outward, and therefore, the sheet roll is held by the feeding reel.

As described above, the use of the elongated sheet feeding reel makes it possible to rotate the sheet roll on the flange member during the operation of connecting the elongated sheets. This achieves an excellent operability for connecting the elongated sheet to the sheet roll set on the feeding reel in the lower tier.

Further, after the core member has been attached to the flange member, the sheet roll is integrated into the feeding reel. Thus, when the elongated sheet is being fed, the sheet roll from which the elongated sheet is being fed does not rotate relative to the feeding reel. Further, the elongated sheet does not become twisted due to a positional shift in the connection portion of the elongated sheet.

Further, in the elongated sheet feeding reel, unlike a conventional feeding reel, non-slip members formed of a material such as a rubber are not bonded to the surface, of the flange member, that is in contact with the sheet roll. Thus, when the sheet roll from which the elongated sheet is being fed is switched to another sheet roll adjacent to the sheet roll, the elongated sheet does not become twisted as a result of the winding end portion of the sheet roll, from which the elongated sheet is being fed, becoming caught by the flange member. This makes it possible to smoothly feed the elongated sheet.

Further, the elongated sheet feeding reel according to the invention of claim 2 includes: a generally cylindrical secondary core member, which is to be fittingly inserted into an inner circular portion of a sheet roll and is divided circumferentially so as to be able to expand a diameter thereof; a primary core member, which is to be fittingly inserted into the cylindrical secondary core member fittingly inserted in the sheet roll; and a disk-shaped flange member, which is to be detachably attached to at least one end of the primary core member. The primary core member has a pressing member, which is to press radially outward an inner peripheral surface of the secondary core member fittingly inserted in the inner circular portion of the sheet roll. Thus, in the state where a sheet roll not having a tubular support such as a paper tube in advance, or a sheet roll from which a tubular support such as a paper tube has been removed to pull out the winding end portion of the elongated sheet, is placed on the disk-shaped flange member to which the primary core member is not attached, the secondary core member is fittingly inserted into the inner circular portion of the sheet roll. Subsequently, the operation of connecting the elongated sheets is performed. After the connecting operation has been completed, the primary core member is fittingly inserted into the secondary core member and attached to the flange member. Consequently, the pressing member presses an inner peripheral surface of a tubular support of the sheet roll radially outward through the secondary core member. Thus, the feeding reel can certainly hold also the sheet roll not having a tubular support such as a paper tube in advance, or the sheet roll from which a tubular support such as a paper tube has been removed to pull out the winding end portion of the elongated sheet.

As described above, similarly to the elongated sheet feeding reel according to the invention of claim 1, the use of the elongated sheet feeding reel makes it possible to rotate the sheet roll on the flange member during the operation of connecting the elongated sheets. This achieves an excellent operability for connecting the elongated sheet to the sheet roll set on the feeding reel in the lower tier. After the primary core member has been attached to the flange member, the sheet roll is integrated into the feeding reel. Thus, when the elongated sheet is being fed, the sheet roll from which the elongated sheet is being fed does not rotate relative to the feeding reel. Further, the elongated sheet does not become twisted due to a positional shift in the connection portion of the elongated sheet.

Particularly, the elongated sheet feeding reel includes rotation stopping means for stopping the rotation of the secondary core member and the primary core member relative to each other. Thus, the secondary core member does not rotate relative to the primary core member, and therefore, the primary core member certainly stops the rotation of the sheet roll.

Further, in the elongated sheet feeding reel according to the invention of claim 3, a secondary core member has a pressing member, which is to press an outer peripheral surface of a primary core member radially inward, and the elongated sheet feeding reel includes rotation stopping means for stopping the rotation of the secondary core member and the primary core member relative to each other. Thus, by a method similar to that of the elongated sheet feeding reel according to the invention of claim 2, it is possible to set a sheet roll not having a tubular support such as a paper tube in advance, or a sheet roll from which a tubular support such as a paper tube has been removed to pull out the winding end portion of the elongated sheet. This makes it possible to obtain an operational effect similar to that of the elongated sheet feeding reel according to the invention of claim 2.

DESCRIPTION OF EMBODIMENTS

Figure 1:
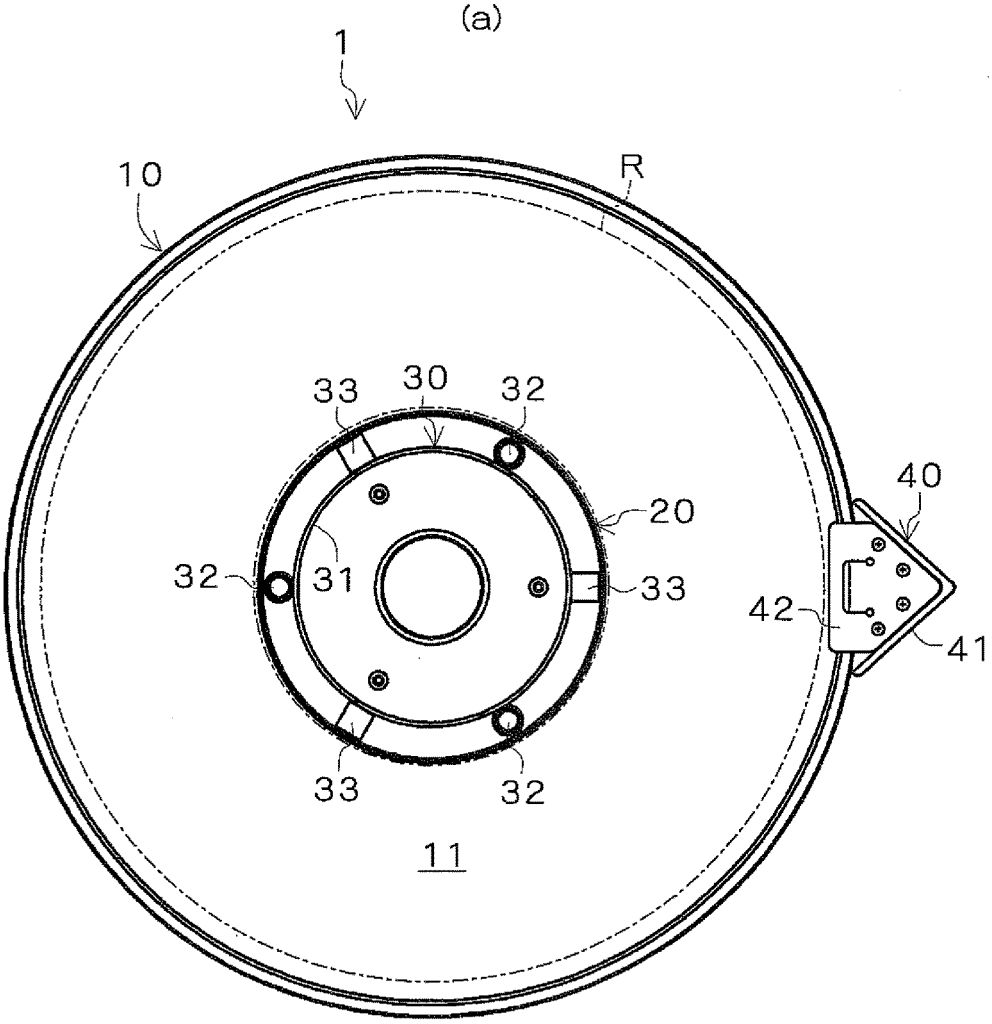
In FIG. 1, (a) is a plan view of an embodiment of a feeding reel according to the invention; and (b) is a side view of the feeding reel.
Figure 1:
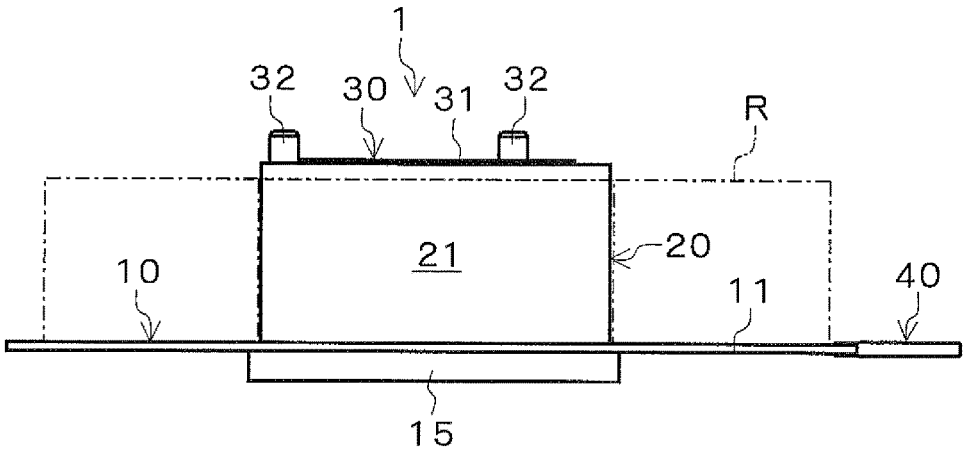

With reference to the drawings, embodiments are described below. As shown in (a) and (b) of FIG. 1, a feeding reel 1 is used to stack sheet rolls R, each of which has been formed by winding an elongated sheet into a roll and from each of which a tubular support such as a paper tube has been removed, one on another in a multi-tiered manner, and to continuously feed the elongated sheets from the respective sheet rolls R. The feeding reel 1 includes: a disk-shaped flange member 10, on which a sheet roll R is to be placed; a generally cylindrical secondary core member 20, which is to be fittingly inserted into an inner circular portion of the sheet roll R and is divided circumferentially so as to be able to expand the diameter thereof; a primary core member 30, which is to be fittingly attached to the inside of the generally cylindrical secondary core member 20 fittingly inserted in the sheet roll R; and a stopper member 40, which is attached to the periphery of the flange member 10 and overhangs radially outward. The primary core member 30 can be detachably attached to the disk-shaped flange member 10.

Figure 2:
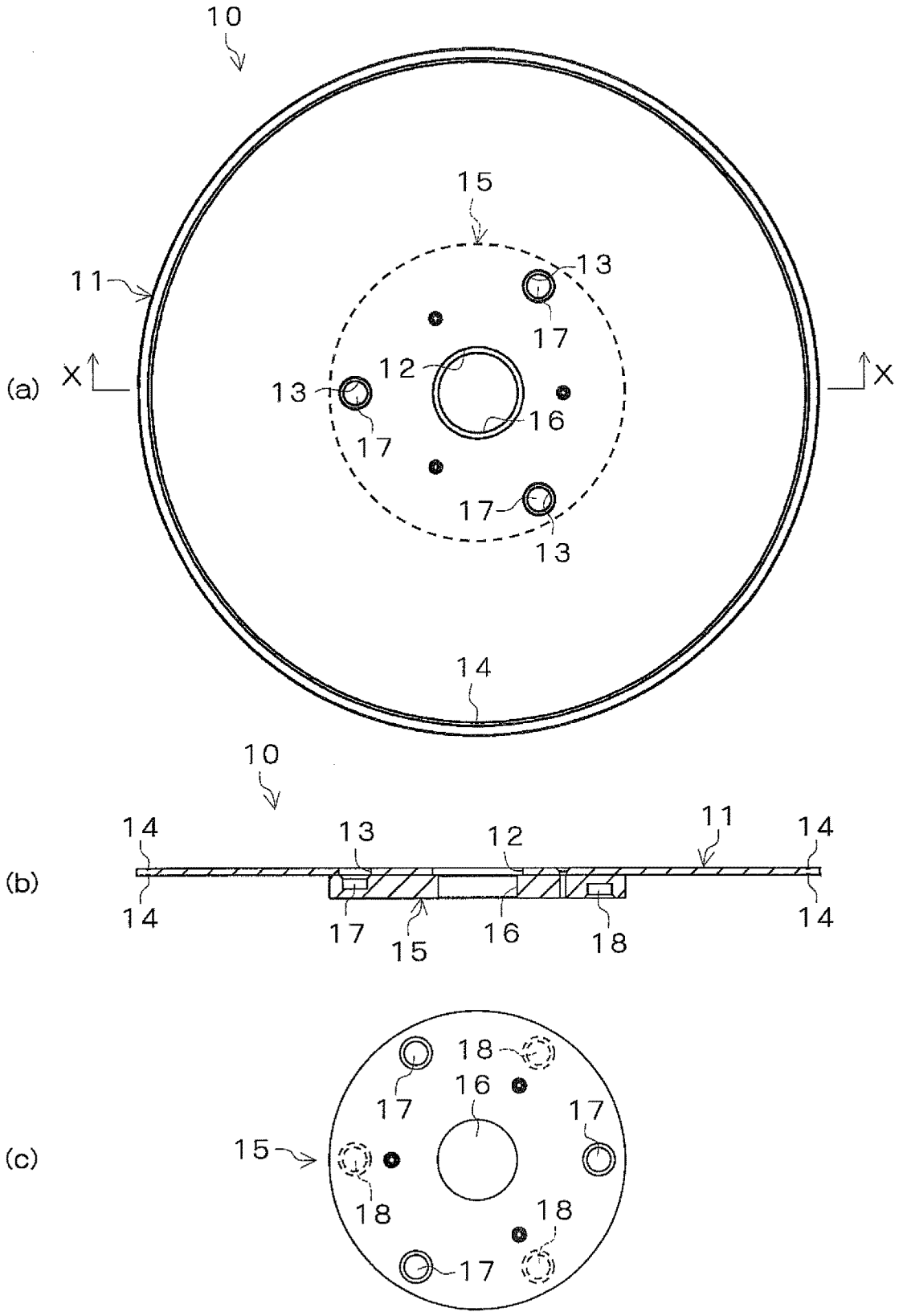
In FIG. 2, (a) is a plan view of a flange member included in the feeding reel; (b) is a cross-sectional view along a line X-X in (a); and (c) is a bottom view of a connection portion included in the flange member.

As shown in (a) and (b) of FIG. 1 and (a) to (c) of FIG. 2, the flange member 10 includes: a main body portion 11 having a thin disk shape with a large diameter; and a connection portion 15 having a thick disk shape with a small diameter and fixed to a central portion of the lower surface of the main body portion 11. The main body portion 11 and the connection portion 15 are formed of a synthetic resin.

In the main body portion 11, a central hole 12 is formed, and three penetrating attachment holes 13 for attaching the primary core member 30 are formed equiangularly on a concentric circle. On peripheral portions of both the upper and lower surfaces of the main body portion 11, annular grooves 14 for supporting the stopper member 40 such that the stopper member 40 is circumferentially movable are formed along the outer periphery of the main body portion 11.

In the connection portion 15, a central hole 16 is formed that has a diameter slightly smaller than that of the central hole 12 formed in the main body portion 11. On the upper surface of the connection portion 15, which is to overlap the lower surface of the main body portion 11, three closed-end attachment holes 17 for attaching the primary core member 30 are formed equiangularly (120 degrees) so as to coincide with the three penetrating attachment holes 13 formed in the main body portion 11. On the lower surface of the connection portion 15, three closed-end attachment holes 18 for attaching the primary core member 30 of the feeding reel 1 in the lower tier when feeding reels 1 have been stacked in a tiered manner are formed equiangularly with a positional shift of 60 degrees from the closed-end attachment holes 17.

Figure 3:
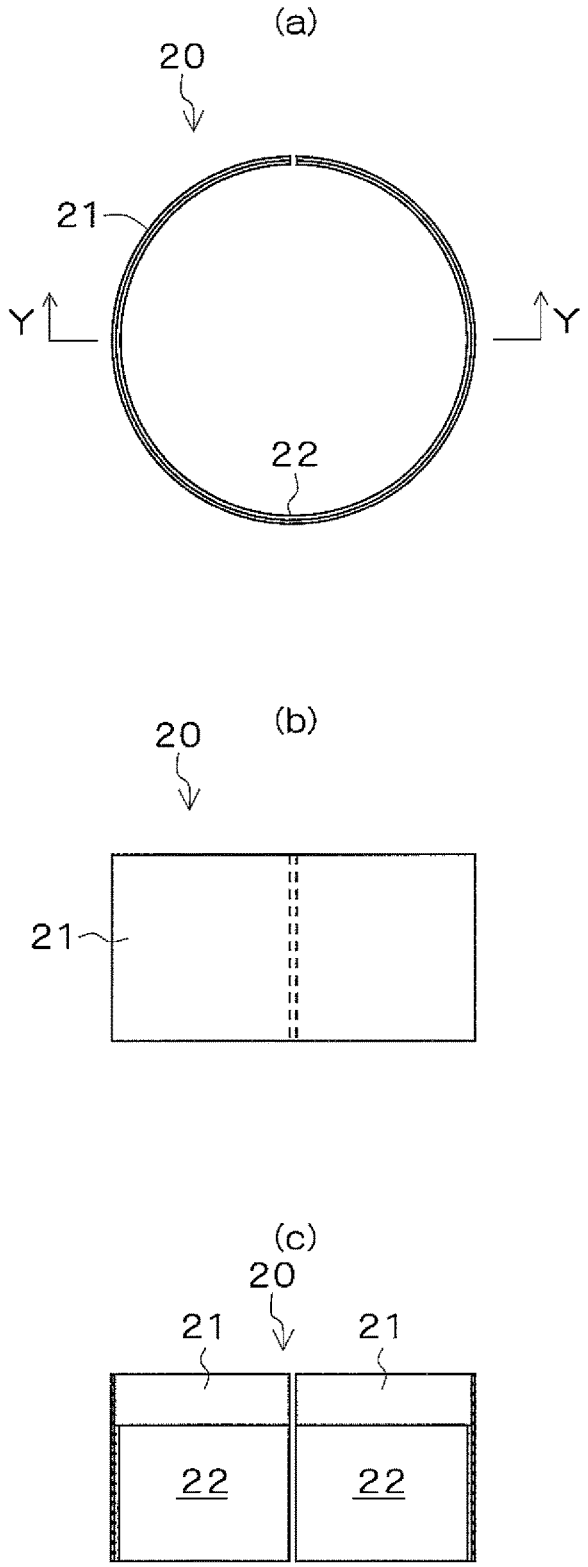
In FIG. 3, (a) is a plan view of a secondary core member included in the feeding reel; (b) is a side view of the secondary core member; and (c) is a cross-sectional view along a line Y-Y in (a).

As shown in (a) and (b) of FIG. 1 and (a) to (c) of FIG. 3, the secondary core member 20 includes: a main body portion 21 formed of a thin metal plate having spring properties and formed to be generally cylindrical; and a non-slip belt 22 bonded to the inner peripheral surface of the main body portion 21 except for an upper end portion of the main body portion 21. The main body portion 21 is not a perfectly cylindrical body, and is divided circumferentially so as to be able to expand the diameter thereof. It should be noted that as the non-slip belt 22, a belt manufactured by Habasit (HAT-8P) and having its surface formed of NBR (nitrile rubber) is used.

Figure 4:
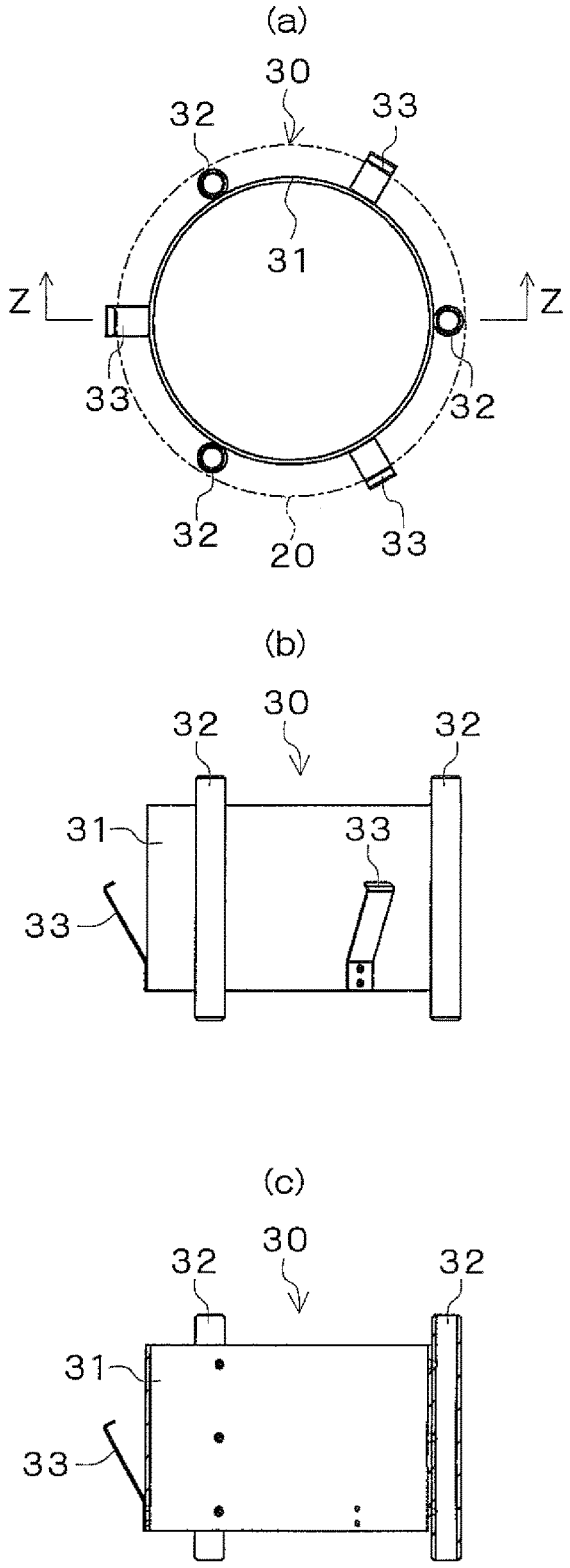
In FIG. 4, (a) is a plan view of a primary core member included in the feeding reel; (b) is a side view of the primary core member; and (c) is a cross-sectional view along a line Z-Z in (a).

The primary core member 30 is formed of a metal. As shown in (a) and (b) of FIG. 1 and (a) to (c) of FIG. 4, the primary core member 30 includes: a cylindrical base member 31 having a diameter smaller than that of the secondary core member 20; three cylindrical connection members 32, which are fixed equiangularly (120 degrees) in the circumferential direction of the base member 31 on the outer peripheral surface of the base member 31 and extend in the up-down direction of the base member 31; and three leaf springs 33, each of which is fixed between adjacent two of the connection members 32 on the outer peripheral surface of the base member 31.

An upper end portion of each connection member 32 protrudes upward from the upper end edge of the base member 31, and a lower end portion of the connection member 32 protrudes downward from the lower end edge of the base member 31. It is possible to connect the flange member 10 to each of an upper end portion and a lower end portion of the primary core member 30 by fittingly inserting these protruding portions into the closed-end attachment hole 18 of the flange member 10, or the penetrating attachment hole 13 and the closed-end attachment hole 17 of the flange member 10.

Each leaf spring 33 is fixed at a lower end portion thereof to a lower end portion of the base member 31 and stands obliquely upward so that the upper end side of the leaf spring 33 overhangs radially outward from the base member 31. It should be noted that in a no-load state, the diameter of a concentric circle passing through an upper end portion of each leaf spring 33 is larger than that of the secondary core member 20 indicated by a dashed-dotted line in (a) of FIG. 4. In the state where the primary core member 30 is fittingly attached to the inside of the secondary core member 20, the upper end portion of the leaf spring 33 elastically deforms radially inward. Thus, a spring force acts on the secondary core member 20 so as to bias the secondary core member 20 radially outward.

Figure 5:
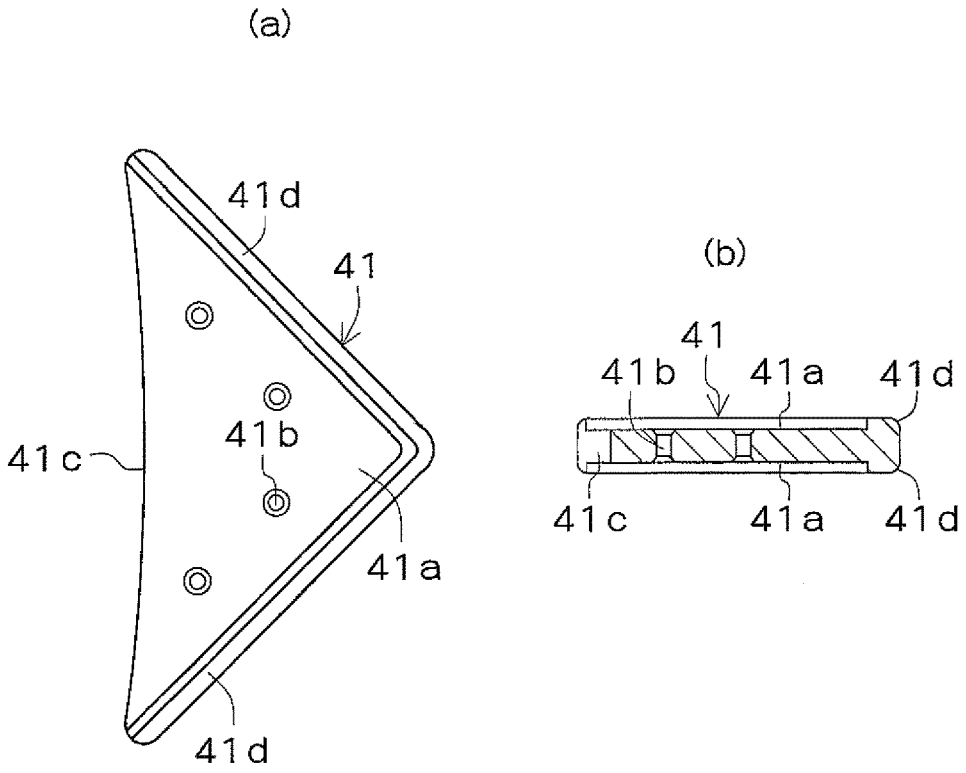
In FIG. 5, (a) is a plan view of a main body portion included in a stopper member of the feeding reel; and (b) is a cross-sectional view of the main body portion.
Figure 6:
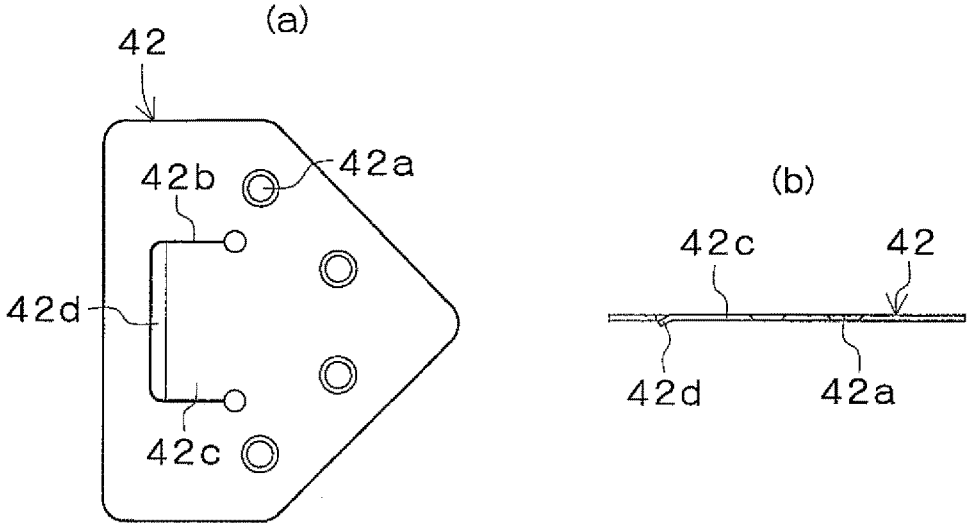
In FIG. 6, (a) is a plan view of each of support plates included in the stopper member; and (b) is a cross-sectional view of the support plate.
Figure 7:
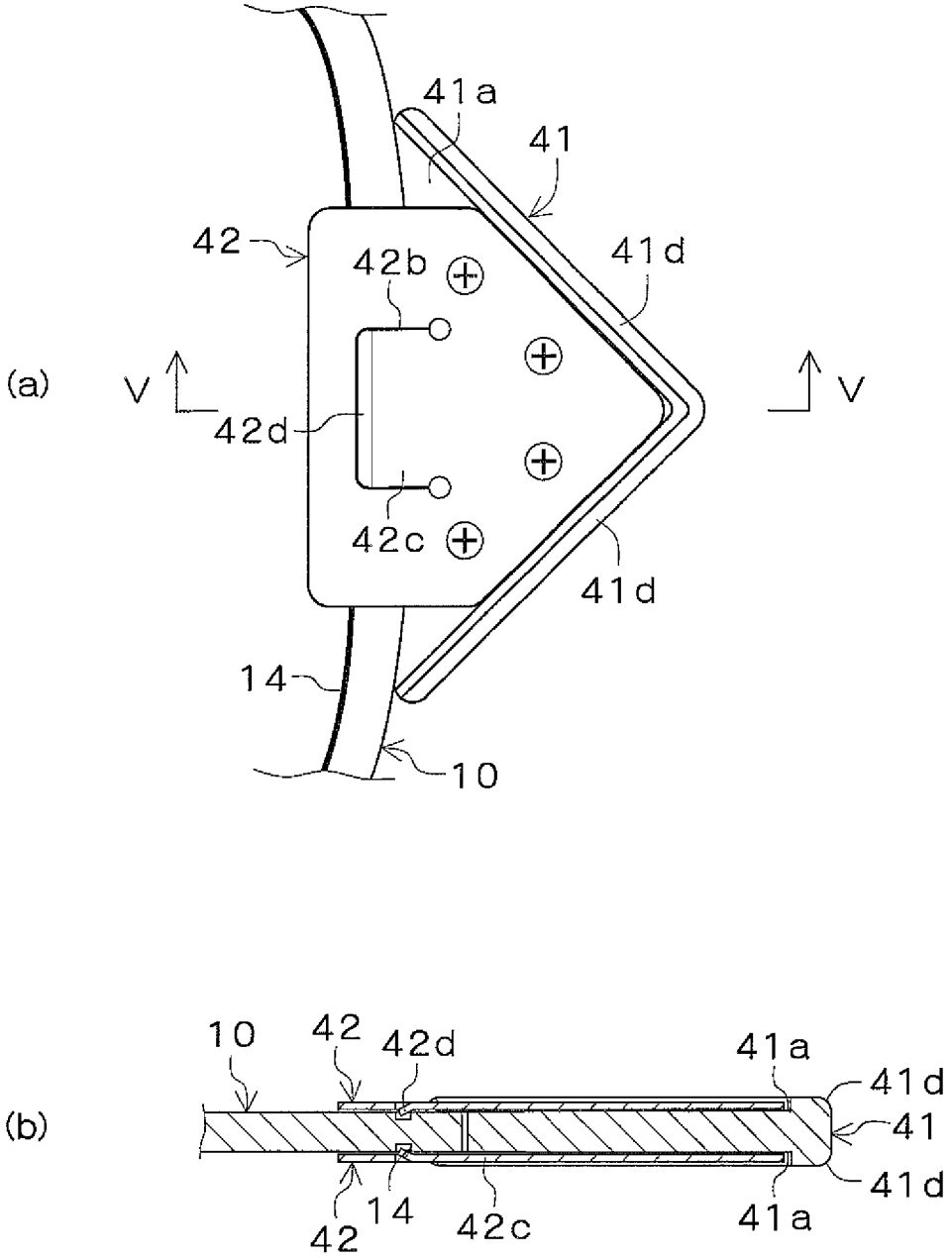
In FIG. 7, (a) is an enlarged plan view of an attachment portion of the stopper member; and (b) is a cross-sectional view along a line V-V in (a).

As shown in FIGS. 5 to 7, the stopper member 40 includes a main body portion 41 and support plates 42. When, with a plurality of feeding reels 1 stacked one on another in a multi-tiered manner, a winding end portion or a winding start portion of the elongated sheet on the feeding reel 1 in the upper tier has been connected to a winding start portion or a winding end portion of the elongated sheet on the feeding reel 1 in the lower tier adjacent to the upper tier, the main body portion 41 hooks the connection portion on the flange member 10 in the circumferential direction of the flange member 10. The support plates 42 attach the main body portion 41 to the flange member 10 such that the main body portion 41 is movable along the periphery of the flange member 10.

As shown in (a) and (b) of FIG. 5, the main body portion 41 is formed of a metal plate having an approximate isosceles right triangular shape and a thickness slightly larger than that of the flange member 10. On the upper and lower surfaces of the main body portion 41, depressed portions 41*a* are formed, into which the support plates 42 described later are to fit. In the formation areas of the depressed portions 41*a*, screw holes 41*b* are formed to penetrate the main body portion 41 in the up-down direction thereof in order to fix the support plates 42.

Further, in the main body portion 41, a portion 41*c* corresponding to the base of the approximate isosceles right triangle is formed to have an arcuate shape with the same radius of curvature as that of the flange member 10 so as to extend along the outer peripheral surface of the flange member 10. Upper and lower corner portions 41*d* corresponding to the hypotenuses of the approximate isosceles right triangle are portions with which the elongated sheet comes into contact, and therefore are rounded so as not to damage the elongated sheet in contact therewith.

As shown in (a) and (b) of FIG. 6, each support plate 42 is formed of a thin metal plate having an extremity portion formed to have an approximate isosceles right triangular shape. In the approximate isosceles right triangular portion at the extremity, screw insertion holes 42*a* are formed to correspond to the screw holes 41*b* of the main body portion 41. Thus, as shown in (a) and (b) of FIG. 7, the extremity portions having the approximate isosceles right triangular shapes are fit into and screwed to the upper and lower depressed portions 41*a* of the main body portion 41, thereby fixing the pair of support plates 42 while sandwiching the main body portion 41 from above and below. In this state, back end portions of the support plates 42 overhang backward from the main body portion 41.

Further, in the back end portion of each support plate 42, a tongue-shaped piece 42*c* is formed by a U-shaped cut 42*b*. The tongue-shaped piece 42*c* is bent so that an extremity portion of the tongue-shaped piece 42*c* slightly protrudes toward the inner surface side of the support plate 42 attached to the main body portion 41. As shown in (b) of FIG. 7, the bent portions 42*d* of the tongue-shaped pieces 42*c* are designed to fit into the annular grooves 14 formed on both the upper and lower surfaces of the flange member 10 described above. The bent portions 42*d* of the tongue-shaped pieces 42*c* fit into the annular grooves 14, whereby the main body portion 41 is positioned in the radial direction of the flange member 10, and the main body portion 41 is supported by the flange member 10 such that the main body portion 41 is movable around the outer periphery of the flange member 10 along the annular grooves 14.

Figure 8:
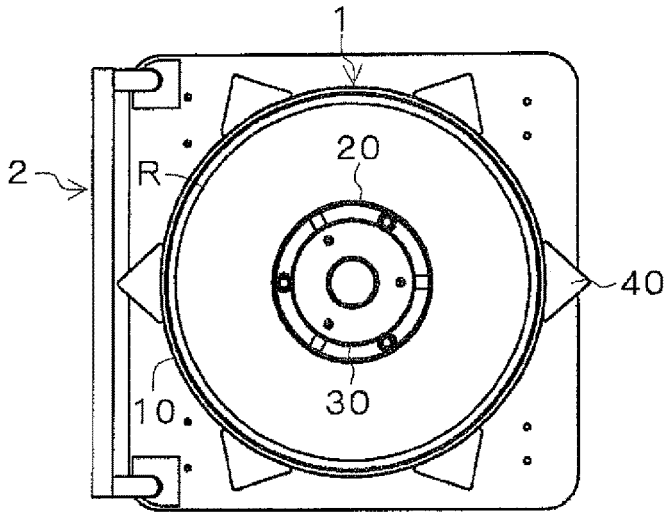
In FIG. 8, (a) is a plan view of the state where feeding reels on which sheet rolls are set are stacked one on another in a multi-tiered manner on a sheet roll mounting platform truck; and (b) is a side view of the same state.
Figure 8:
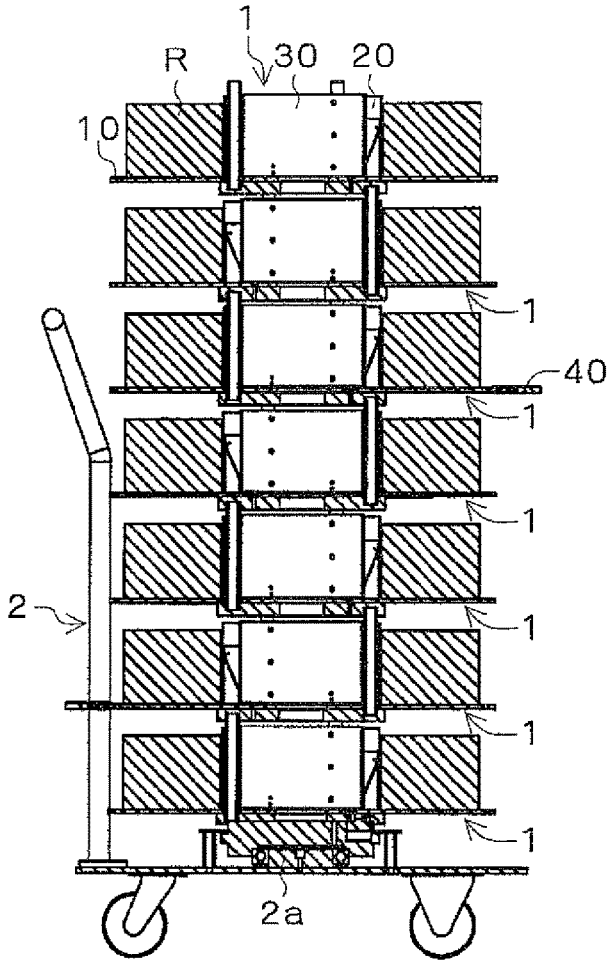

As shown in (a) and (b) of FIG. 8, feeding reels 1 configured as described above are stacked one on another in a multi-tiered manner on a rotary base 2*a* of a sheet roll mounting platform truck 2, while sheet rolls R, each of which has been formed by winding an elongated sheet into a roll and from each of which a tubular support such as a paper tube has been removed, are set on the respective feeding reels 1. When the feeding reels 1 are stacked in a tiered manner, an inner end portion (the winding start portion) pulled out from the sheet roll R set on the feeding reel 1 in the upper tier is connected to an outer end portion (the winding end portion) of the sheet roll R set on the feeding reel 1 in the lower tier adjacent to the upper tier, and such connections are sequentially made. With reference to the drawings, a method for setting a sheet roll R is described below.

Figure 9:
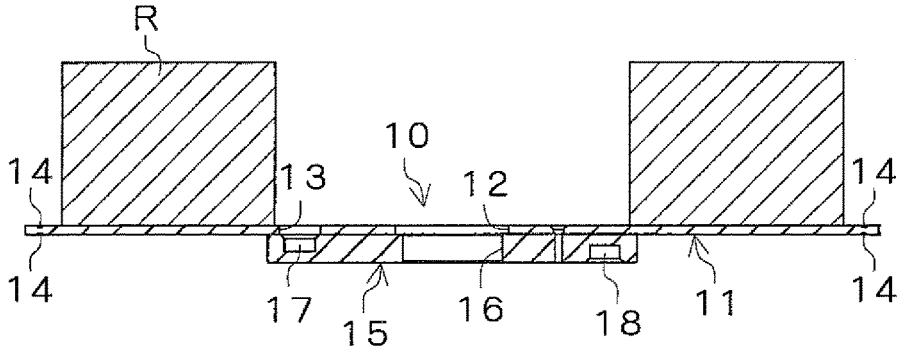
In FIG. 9, (a) to (c) are process diagrams illustrating a method for setting a sheet roll using the feeding reel.
Figure 9:
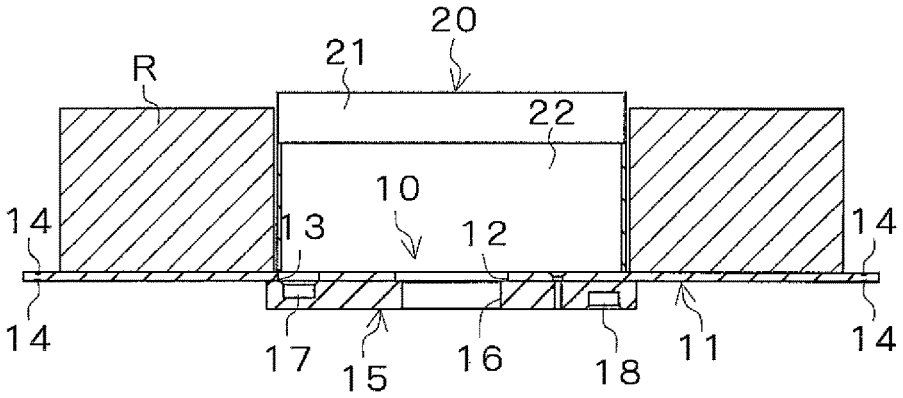
Figure 9:
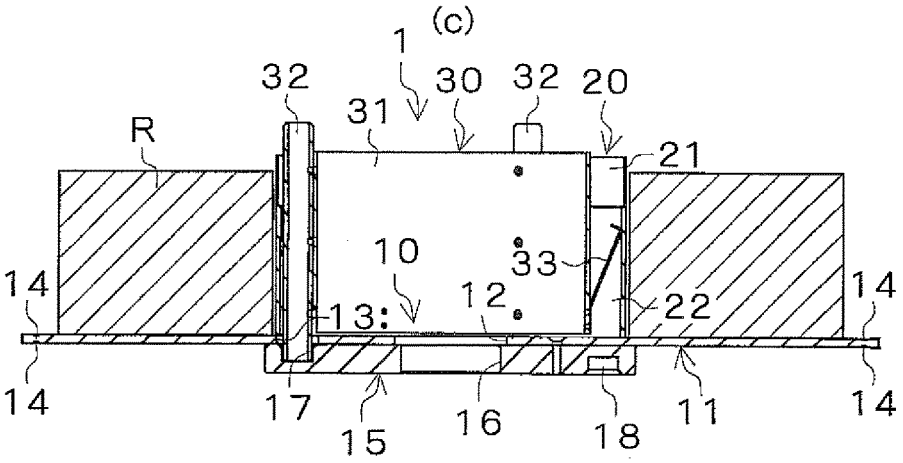

First, the flange member 10 is attached to the rotary base 2*a* of the sheet roll mounting platform truck 2. As shown in (a) of FIG. 9, a sheet roll R from which a tubular support such as a paper tube has been removed is placed on the upper surface of the flange member 10 at a predetermined position. Thereafter, as shown in (b) of FIG. 9, the secondary core member 20 is fittingly inserted into the inner circular portion of the sheet roll R. It should be noted that (a) to (c) of FIG. 9 omit the rotary base 2*a* of the sheet roll mounting platform truck 2.

Subsequently, the primary core member 30 is fittingly inserted into the secondary core member 20, and the lower end portions of the three connection members 32 are fit into the penetrating attachment holes 13 and the closed-end attachment holes 17 of the flange member 10, thereby connecting the flange member 10 to the primary core member 30. At this time, the leaf springs 33 of the primary core member 30 press the inner peripheral surface of the secondary core member 20 radially outward. Thus, the resulting pressing force expands the diameter of the secondary core member 20, thereby pressing the inner peripheral surface of the sheet roll R. Consequently, the sheet roll R is held by the primary core member 30 through the secondary core member 20.

It should be noted that as described above, the non-slip belt 22 having its surface formed of NBR (nitrile rubber) is bonded to the inner peripheral surface of the secondary core member 20. This prevents the secondary core member 20 from slipping circumferentially relative to the primary core member 30. Thus, the primary core member 30 certainly stops the rotation of the sheet roll R.

Figure 10:
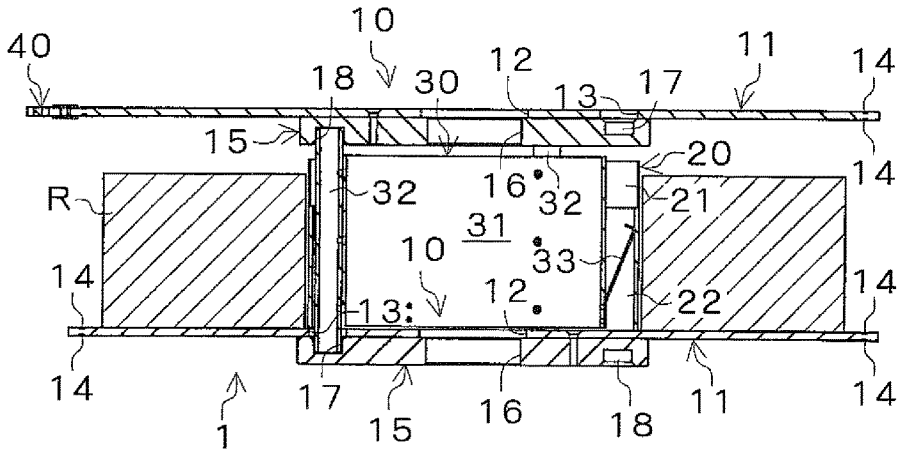
In FIG. 10, (a) and (b) are process diagrams illustrating the method for setting a sheet roll using the feeding reel.
Figure 10:
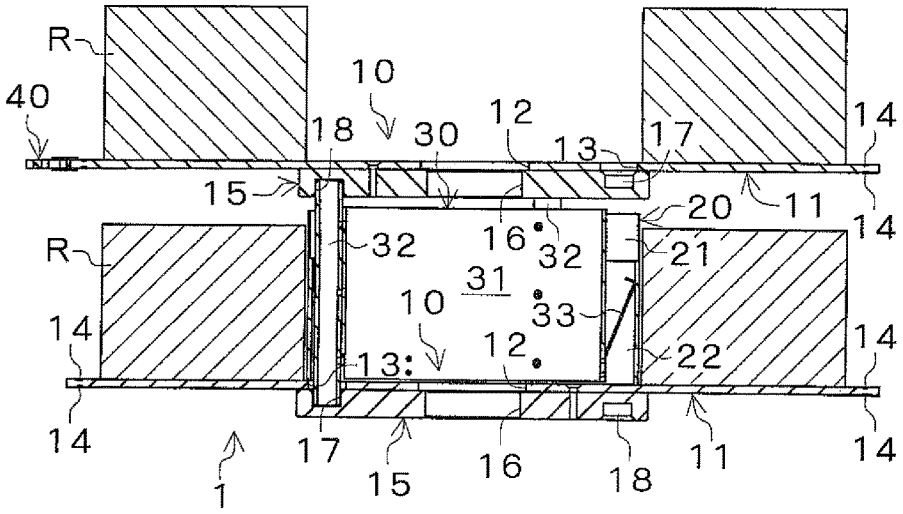

When the setting of the lowermost sheet roll R has thus been completed, as shown in (a) of FIG. 10, the three closed-end attachment holes 18 of another flange member 10 are fit to the upper end portions of the three connection members 32 of the primary core member 30, thereby attaching the flange member 10 to the lowermost primary core member 30. Then, as shown in (b) of FIG. 10, a sheet roll R from which a tubular support such as a paper tube has been removed is placed on the upper surface of the flange member 10 at a predetermined position. It should be noted that, in placing the sheet roll R on the flange member 10, it is necessary in advance to pull out the winding start portion of the sheet roll R such that the winding start portion is placed outside the sheet roll R by a predetermined length, place the pulled out portion along the upper surface of the flange member 10 in the second tier from the bottom, and place an extremity portion of the pulled out portion outside the flange member 10.

Figure 11:
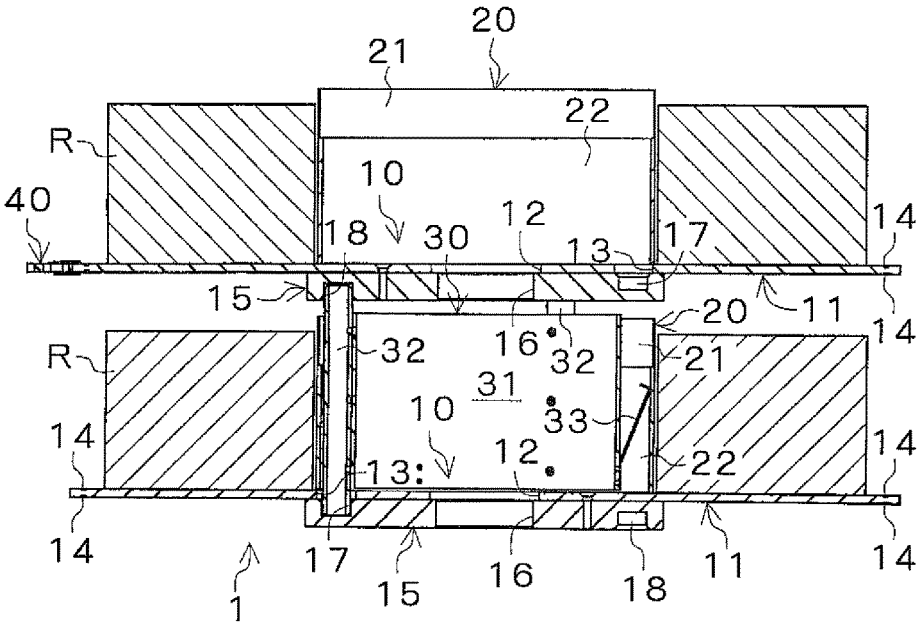
In FIG. 11, (a) and (b) are process diagrams illustrating the method for setting a sheet roll using the feeding reel.
Figure 11:
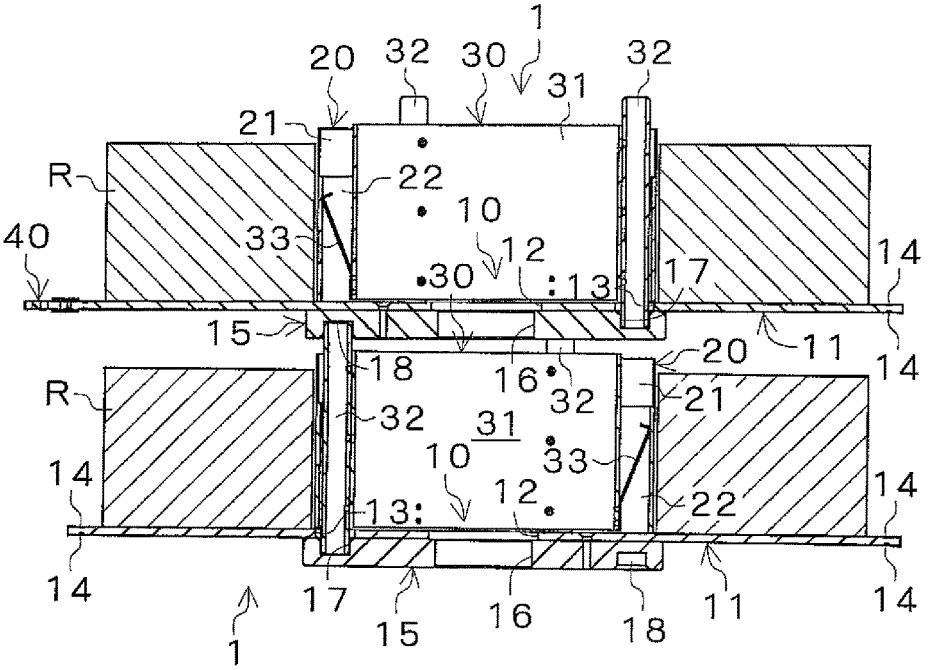

Subsequently, as shown in (a) of FIG. 11, the secondary core member 20 is fittingly inserted into the inner circular portion of the sheet roll R. In this state, the winding end portion of the sheet roll R in the lower tier is connected to the already pulled out winding start portion of the sheet roll R in the upper tier. In this state, the sheet roll R is merely placed on the flange member 10, which makes it possible to easily adjust the connection position by circumferentially rotating the sheet roll R. This achieves an excellent operability for connection. Further, at this time, the stopper member 40 attached to the flange member 10 may be evacuated in advance to a position away from the connection portion of the elongated sheets by sliding the stopper member 40 in the circumferential direction of the flange member 10. This prevents the interference of the stopper member 40, which makes it possible to smoothly perform the operation of connecting the elongated sheets.

Figure 12:
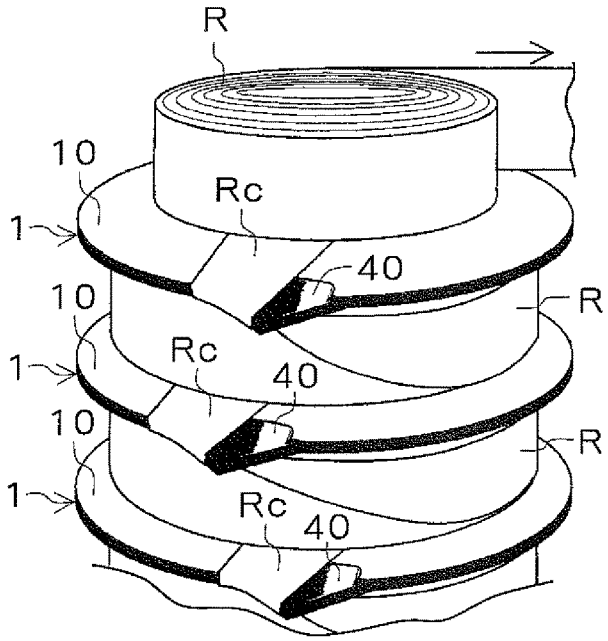
FIG. 12 is a perspective view of the state of use of feeding reels.

When the connection of the elongated sheets of the sheet rolls R adjacent to each other, one above the other, has thus been completed, the stopper member 40 is moved to the connection portion of the elongated sheets by sliding the stopper member 40 in the circumferential direction of the flange member 10. Then, as shown in FIG. 12, a connection portion Rc of the elongated sheets is hooked on the stopper member 40 by pressing the stopper member 40 against the connection portion Rc of the elongated sheets such that a predetermined tension is imparted to the connection portion Rc of the elongated sheets.

Subsequently, the primary core member 30 is fittingly inserted into the secondary core member 20, and the lower end portions of the three connection members 32 are fit into the penetrating attachment holes 13 and the closed-end attachment holes 17 of the flange member 10 in the second tier from the bottom, thereby connecting the flange member 10 to the primary core member 30. Consequently, the sheet roll R is held by the primary core member 30 through the secondary core member 20 similarly to the sheet roll R in the first tier from the bottom. Thereafter, similarly, feeding reels 1 are stacked in a tiered manner, while sheet rolls R are set on the respective feeding reels 1.

When the stacking of the sheet rolls R in a tiered manner has thus been completed, the group of the feeding reels stacked in a tiered manner are integrated together by fixing means, not shown in the figures, pressing down the group of the feeding reels against the rotary base 2*a* from above. Then, an elongated sheet S starts to be fed from the sheet roll R set on the uppermost feeding reel 1.

As described above, the use of the elongated sheet feeding reel 1 makes it possible to rotate the sheet roll R on the flange member 10 during the operation of connecting the elongated sheets. This achieves an excellent operability for connecting the elongated sheet to the sheet roll R set on the feeding reel 1 in the lower tier. After the primary core member 30 has been attached to the flange member 10, the sheet roll R is integrated into the feeding reel 1. Thus, when the elongated sheet is being fed, the sheet roll R from which the elongated sheet is being fed does not rotate relative to the feeding reel 1. Further, the elongated sheet does not become twisted due to a positional shift in the connection portion of the elongated sheet.

Particularly, in the elongated sheet feeding reel 1, the non-slip belt 22, which increases the frictional force between the secondary core member 20 and the leaf springs 33, is bonded to the inner peripheral surface of the secondary core member 20. This makes it difficult for the secondary core member 20 to slip circumferentially relative to the primary core member 30. Thus, it is possible to certainly achieve the function of stopping the rotation of the sheet roll R relative to the feeding reel 1.

Further, in the elongated sheet feeding reel 1, unlike a conventional feeding reel, non-slip members formed of a material such as a rubber are not bonded to the upper surface of the flange member 10. Thus, when the sheet roll R from which the elongated sheet is being fed is switched from the sheet roll R in the upper tier to the sheet roll R in the lower tier, the elongated sheet does not become twisted as a result of the winding end portion of the sheet roll R in the upper tier becoming caught by the flange member. This makes it possible to always smoothly feed the elongated sheet.

Figure 13:
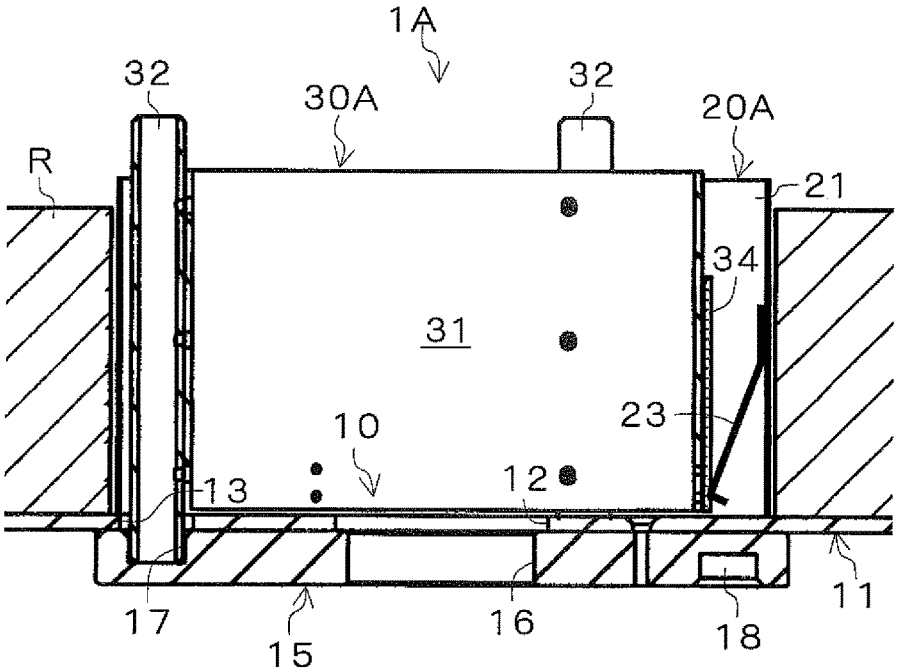
FIG. 13 is a partially enlarged cross-sectional view of another embodiment.

It should be noted that in the above embodiment, the leaf springs 33 are fixed to the base member 31 of the primary core member 30. The invention, however, is not limited to this. For example, as in a feeding reel 1A shown in FIG. 13, leaf springs 23 that overhang radially inward may be fixed to the inner peripheral surface of a main body portion 21 of a secondary core member 20A. In this case, upper end portions of the leaf springs 23 need to be fixed to the secondary core member 20A so that the extremity side of each leaf spring 23 is directed downward. Thus, a non-slip belt 34 is bonded to the outer peripheral surface of a base member 31 of a primary core member 30A. It should be noted that it is preferable that each leaf spring 23 should be fixed to an approximately middle portion, in the height direction, of the main body portion 21 of the secondary core member 20A in order to uniformly press the inner peripheral surface of the sheet roll R.

Further, in the above embodiments, the non-slip belt 22 is bonded to the inner peripheral surface of the secondary core member 20, or the non-slip belt 34 is bonded to the outer peripheral surface of the base member 31 of the primary core member 30A. The invention, however, is not limited to this, and can employ a configuration where non-slip members cover the leaf springs 33 or the leaf springs 23.

Figure 14:
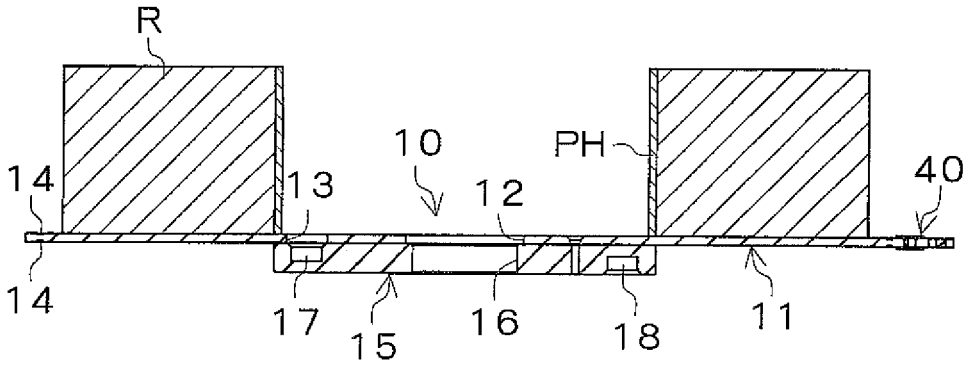
In FIG. 14, (a) and (b) are process diagrams illustrating a method for setting a sheet roll to which a tubular support such as a paper tube is attached.
Figure 14:
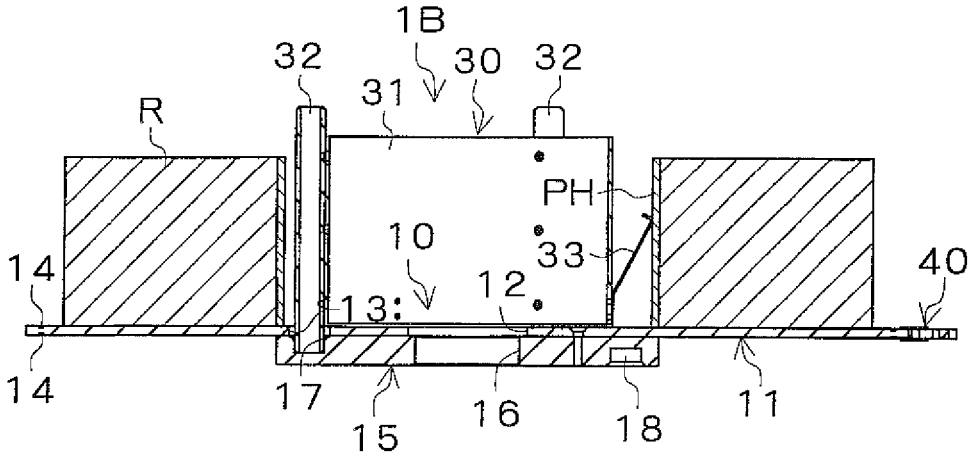

Further, in the above embodiments, the descriptions are given of the feeding reels 1 and 1A, which are used to stack the sheet rolls R, from each of which a tubular support such as a paper tube has been removed, in a tiered manner. Alternatively, for example, a tubular support such as a paper tube may be once removed from each sheet roll R and the winding start portion of the sheet roll R may be pulled out, and thereafter, the sheet rolls R, to each of which the tubular support such as a paper tube has been attached, may be stacked in a tiered manner again. In this case, it is not necessary to use the secondary core member 20. As shown in (b) of FIG. 14, the use of a feeding reel 1B including a flange member 10 and a primary core member 30 makes it possible to certainly stop the rotation of the sheet roll R relative to the feeding reel 1B. Particularly, if non-slip members cover the leaf springs 33, the function of stopping the rotation of the sheet roll relative to the feeding reel 1B is further improved.

In this case, the sheet rolls R may be set in the following manner. As shown in (a) of FIG. 14, with the winding start portion pulled out in advance (although the winding start portion of the lowermost sheet roll does not need to be pulled out in advance), the sheet roll R to which a tubular support PH such as a paper tube is attached is placed on the flange member 10 at a predetermined position. Thereafter, the winding end portion of the sheet roll R in the lower tier is connected to the winding start portion of the already pulled out sheet roll R in the upper tier. Thereafter, as shown in (b) of FIG. 14, the primary core member 30 is fittingly inserted into the tubular support PH of the sheet roll R, and the lower end portions of the three connection members 32 are fit into the penetrating attachment holes 13 and the closed-end attachment holes 17 of the flange member 10 in the second tier from the bottom, thereby connecting the flange member 10 to the primary core member 30.

Figure 15:
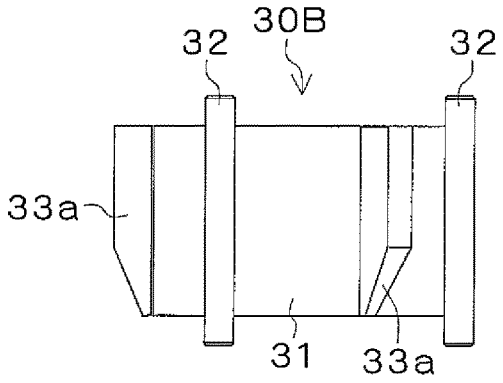
FIG. 15 is a side view of a variation of a primary core member.

Further, the above embodiments employ the leaf springs 33 or the leaf springs 23 as pressing members for pressing radially outward the inner peripheral surface of the secondary core member 20 fittingly inserted in the inner circular portion of the sheet roll R from which a tubular support such as a paper tube has been removed, or the inner peripheral surface of a tubular support, such as a paper tube, of the sheet roll R to which the tubular support is attached. The invention, however, is not limited to this. For example, it goes without saying that as shown in FIG. 15, as pressing members, a plurality of wedge-shaped members 33*a* can be provided on the outer peripheral surface of a base member 31 included in a primary core member 30B, the amount of radially outward overhang of each wedge-shaped member 33*a* gradually decreasing toward the lower end side thereof. On the contrary, as pressing members, a plurality of wedge-shaped members can be successively provided on the inner peripheral surface of a secondary core member, the amount of radially inward overhang of each wedge-shaped member gradually decreasing toward the upper end side thereof. Alternatively, it is possible to employ various types of pressing members such as a chuck mechanism that opens by fittingly inserting a primary core member into a secondary core member 20 or a tubular support.

Figure 16:
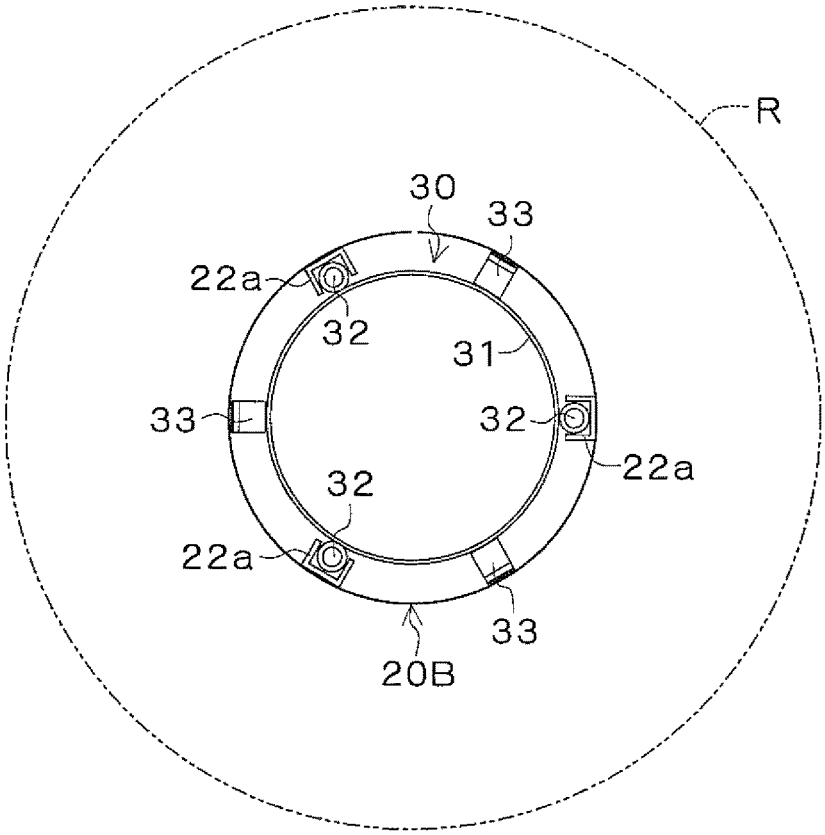
FIG. 16 is a plan view of a variation of rotation stopping means.
Figure 17:
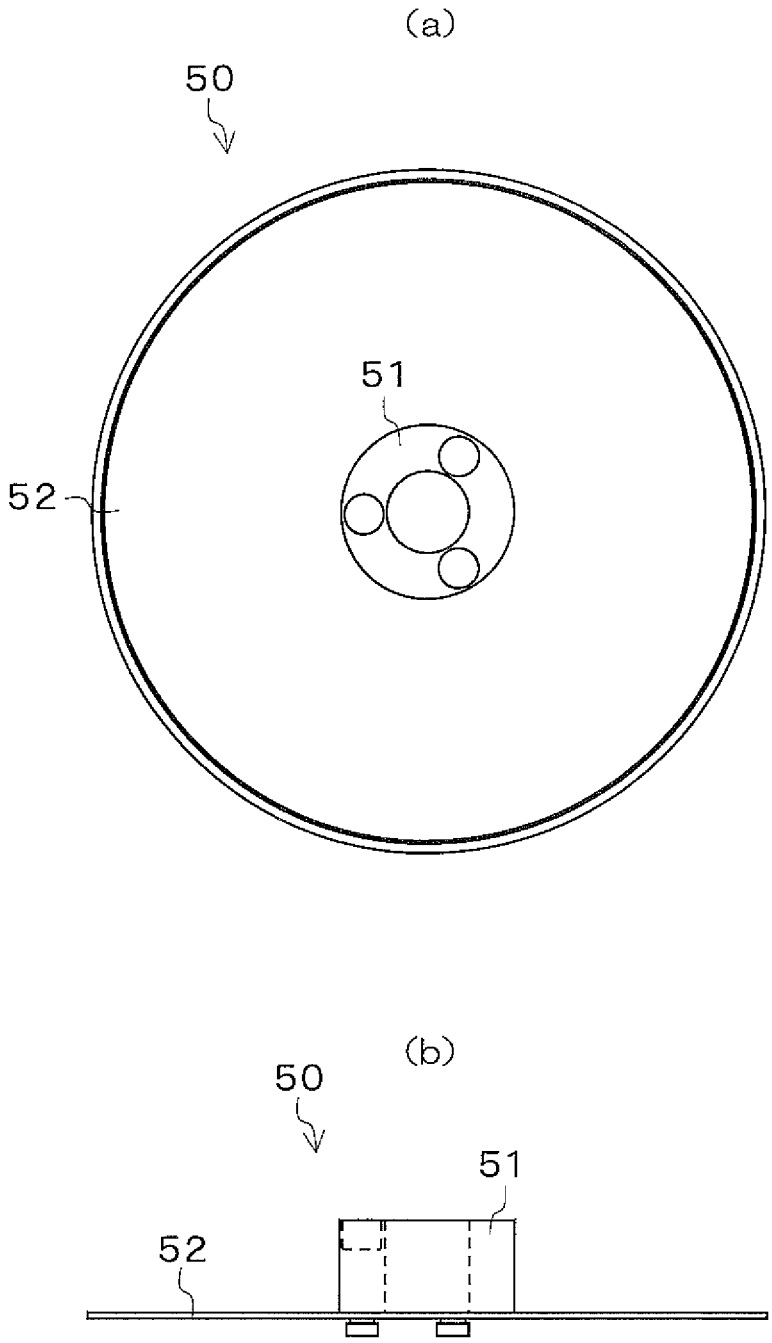
In FIG. 17, (a) is a plan view of a conventional feeding reel; and (b) is a side view of the conventional feeding reel.
Figure 18:
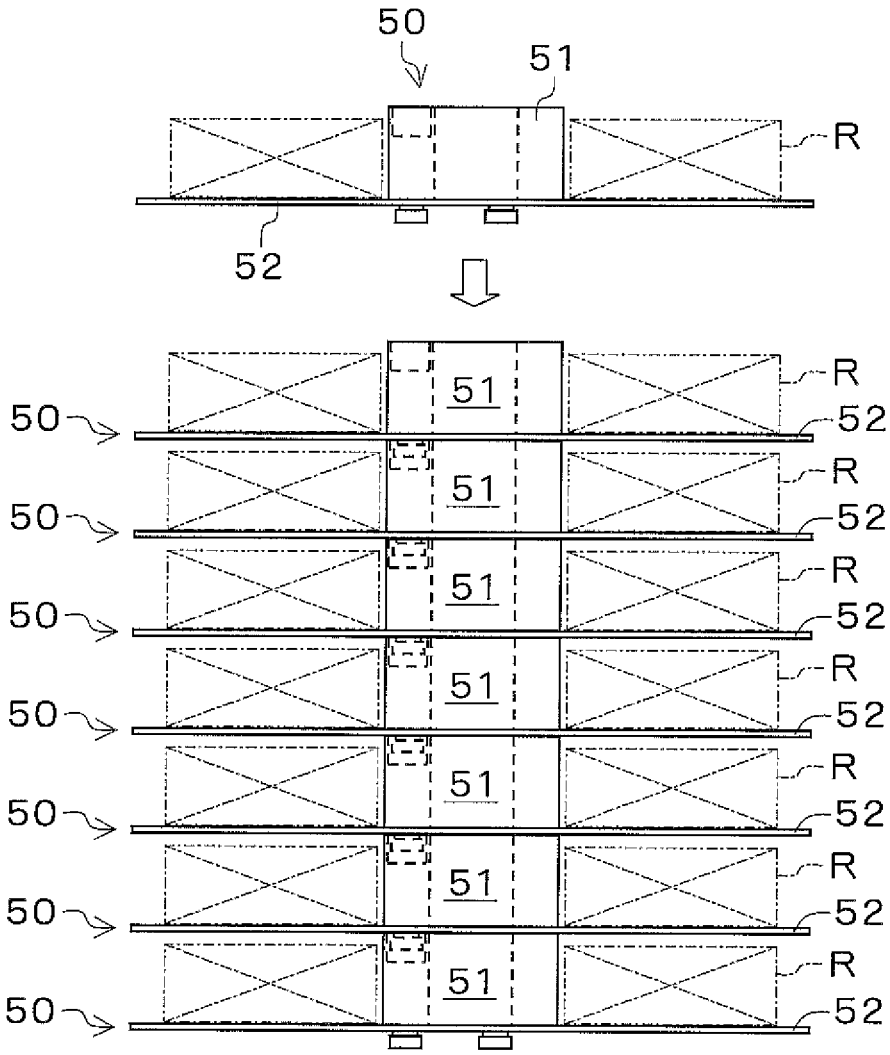
FIG. 18 is a side view of the state where conventional feeding reels on which sheet rolls are set are stacked one on another in a multi-tiered manner.
Figure 19:
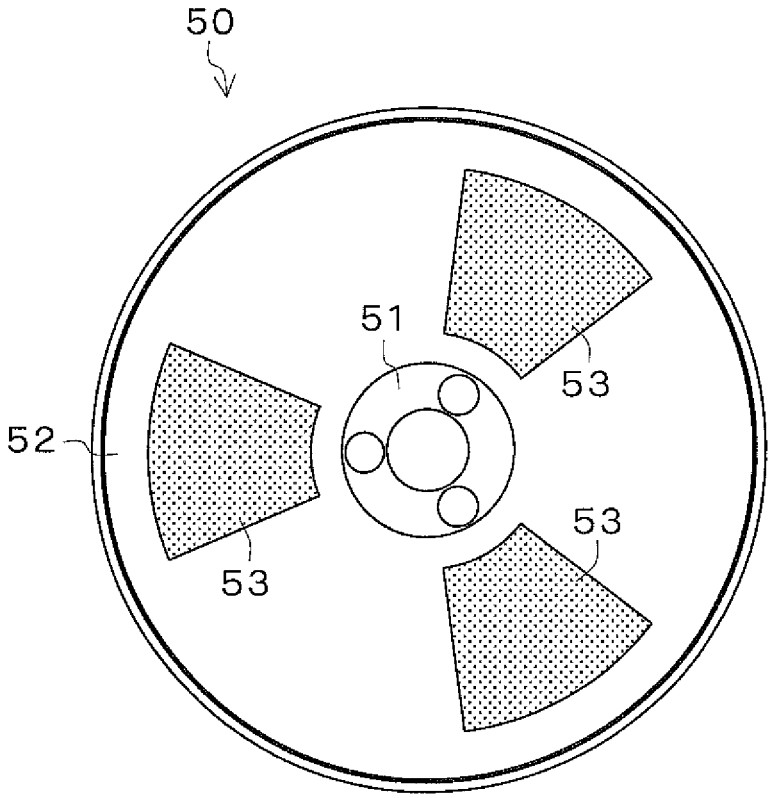
FIG. 19 is a plan view of an example improvement of a conventional feeding reel.

Further, the above embodiments employ, as a rotation stopping member for stopping the rotation of the secondary core member 20 and the primary core members 30 relative to each other, or the rotation of the secondary core member 20A and the primary core member 30A relative to each other, a configuration where the non-slip belt 22 is bonded to the inner peripheral surface of the secondary core member 20, or a configuration where the non-slip belt 34 is bonded to the outer peripheral surface of the base member 31 of the primary core member 30A, or a configuration where the non-slip members cover the leaf springs 33 or the leaf springs 23. The invention, however, is not limited to this. For example, as shown in FIG. 16, it is possible to form a rotation stopping member by providing, on the inner peripheral surface of a secondary core member 20B, fitting members 22*a*, which are to fit the connection members 32 of a primary core member 30. Alternatively, it may be possible to employ as a rotation stopping member a hook-and-loop fastener, a suction cup, a magnet, or the like for connecting the secondary core member 20 to the primary core members 30, or for connecting the secondary core member 20A to the primary core member 30A.

INDUSTRIAL APPLICABILITY

The present invention can be used to stack sheet rolls, each of which has been obtained by winding an elongated sheet such as an elongated strip-like label forming base material into a roll, in a tiered manner, and to continuously feed the elongated sheets.

DESCRIPTION OF THE REFERENCE CHARACTERS

1, 1A, 1B feeding reel
2 sheet roll mounting platform truck
2*a* rotary base
10 flange member
11 main body portion
12 central hole
13 penetrating attachment hole
14 annular groove
15 connection portion
16 central hole
17 closed-end attachment hole
18 closed-end attachment hole
20, 20A, 20B secondary core member
21 main body portion
22 non-slip belt
22*a* fitting member
23 leaf spring
30, 30A, 30B primary core member
31 base member
32 connection member
33 leaf spring
33*a* wedge-shaped member
34 non-slip belt
40 stopper member
41 main body portion
42 support plate

42*c* tongue-shaped piece
42*d* curved portion
R sheet roll
PH tubular support

The invention claimed is:

1. An elongated sheet feeding reel for stacking sheet rolls, each of which has been formed by winding an elongated sheet around a tubular support, one on another in a multi-tiered manner, and for continuously feeding the elongated sheets from the respective sheet rolls, the elongated sheet feeding reel comprising:

a core member configured to be fittingly inserted into the tubular support; and a flange member configured to be detachably attached to the core member, wherein the flange member includes (i) a disk-shaped main body portion having an upper surface and a lower surface and (ii) a connection portion disposed on the lower surface of the main body portion and configured to connect the core member to the upper surface of the main body portion, the core member is configured to connect to a connection portion disposed on a lower surface of a disk-shaped main body portion of a second flange member before a corresponding core member of the second flange member is connected to an upper surface of the main body portion of the second flange member, and the core member includes at least one pressing member configured to press an inner peripheral surface of the tubular support radially outward by inserting into the tubular support.

2. An elongated sheet feeding reel for stacking sheet rolls, each of which is formed by winding an elongated sheet without using a tubular support and has an inner circular portion, one on another in a multi-tiered manner, and for continuously feeding the elongated sheets from the respective sheet rolls, the elongated sheet feeding reel comprising:

a circumferentially-expandable cylindrical secondary core member configured to be fittingly inserted into the inner circular portion;

a primary core member configured to be fittingly attached inside of the cylindrical secondary core member fittingly inserted into the inner circular portion;

a rotation stopping member for stopping rotation of the primary core member and the secondary core member relative to each other; and a flange member configured to be detachably attached to the primary core member, wherein the flange member includes (i) a disk-shaped main body portion having an upper surface and a lower surface and (ii) a connection portion disposed on the lower surface of the main body portion and configured to connect the primary core member to the upper surface of the main body portion, the primary core member is configured to connect to a connection portion disposed on a lower surface of a disk-shaped main body portion of a second flange member before a corresponding primary core member of the second flange member is connected to an upper surface of the main body portion of the second flange member, the primary core member includes at least one pressing member configured to press radially outward an inner peripheral surface of the secondary core member by fittingly inserting into the secondary core member fittingly inserted in the inner circular portion.

3. An elongated sheet feeding reel for stacking sheet rolls, each of which is formed by winding an elongated sheet without using a tubular support and has an inner circular portion, one on another in a multi-tiered manner, and for continuously feeding the elongated sheets from the respective sheet rolls, the elongated sheet feeding reel comprising:

a circumferentially-expandable cylindrical secondary core member configured to be fittingly inserted into the inner circular portion;

a primary core member configured to be fittingly attached inside of the cylindrical secondary core member fittingly inserted into the inner circular portion;

a rotation stopping member for stopping rotation of the primary core member and the secondary core member relative to each other; and a flange member configured to be detachably attached to the primary core member, wherein the flange member includes (i) a disk-shaped main body portion having an upper surface and a lower surface and (ii) a connection portion disposed on the lower surface of the main body portion and configured to connect the primary core member to the upper surface of the main body portion, the primary core member is configured to connect to a connection portion disposed on a lower surface of a disk-shaped main body portion of a second flange member before a corresponding primary core member of the second flange member is connected to an upper surface of the main body portion of the second flange member, the secondary core member includes at least one pressing member configured to press radially inward an outer peripheral surface of the primary core member by fittingly inserting the primary core member into the secondary core member in a state of being fittingly inserted into the inner circular portion.

4. The elongated sheet feeding reel according to claim 1, wherein the core member includes a plurality of pressing members and a plurality of connection members, and each pressing member is respectively located between adjacent connection members.

5. The elongated sheet feeding reel according to claim 2, wherein the primary core member includes a plurality of pressing members and a plurality of connection members, and each pressing member is respectively located between adjacent connection members.

6. The elongated sheet feeding reel according to claim 3, wherein the secondary core member includes a plurality of pressing members and the primary core member includes a plurality of connection members, and each pressing member is respectively located between adjacent connection members.

7. The elongated sheet feeding reel according to claim 1, wherein the pressing member comprises at least one selected from the group consisting of a leaf spring, a wedge-shaped member, and a chuck mechanism.

8. The elongated sheet feeding reel according to claim 1, wherein the pressing member comprises a leaf spring.

9. The elongated sheet feeding reel according to claim 1, wherein the pressing member comprises a wedge-shaped member.

10. The elongated sheet feeding reel according to claim 1, wherein the pressing member comprises a chuck mechanism.

11. The elongated sheet feeding reel according to claim 7, wherein the core member includes a plurality of pressing members and a plurality of connection members, and each pressing member is respectively located between adjacent connection members.

12. The elongated sheet feeding reel according to claim 2, wherein the pressing member comprises at least one selected from the group consisting of a leaf spring, a wedge-shaped member, and a chuck mechanism.

13. The elongated sheet feeding reel according to claim 2, wherein the pressing member comprises a leaf spring.

14. The elongated sheet feeding reel according to claim 2, wherein the pressing member comprises a wedge-shaped member.

15. The elongated sheet feeding reel according to claim 2, wherein the pressing member comprises a chuck mechanism.

16. The elongated sheet feeding reel according to claim 12, wherein the primary core member includes a plurality of pressing members and a plurality of connection members, and each pressing member is respectively located between adjacent connection members.

17. The elongated sheet feeding reel according to claim 3, wherein the pressing member comprises at least one selected from the group consisting of a leaf spring, a wedge-shaped member, and a chuck mechanism.

18. The elongated sheet feeding reel according to claim 3, wherein the pressing member comprises a leaf spring.

19. The elongated sheet feeding reel according to claim 3, wherein the pressing member comprises a wedge-shaped member.

20. The elongated sheet feeding reel according to claim 3, wherein the pressing member comprises a chuck mechanism.

21. The elongated sheet feeding reel according to claim 17, wherein the secondary core member includes a plurality of pressing members and the primary core member includes a plurality of connection members, and each pressing member is respectively located between adjacent connection members.

* * * * *